US005423270A

United States Patent [19]

Kilpatrick et al.

[11] Patent Number: 5,423,270

[45] Date of Patent: Jun. 13, 1995

[54] PALLET STRINGER

[75] Inventors: Ted D. Kilpatrick, Ponte Vedra Beach, Fla.; Arthur M. Wagner, Geneva, Ill.

[73] Assignee: Gate Pallet Systems, Inc., Crown Point, Ill.

[21] Appl. No.: 179,111

[22] Filed: Jan. 10, 1994

Related U.S. Application Data

[63] Continuation-in-part of Ser. No. 38,001, Mar. 29, 1993, Pat. No. 5,365,857.

[51] Int. Cl.[6] ..... B65D 19/20

[52] U.S. Cl. ..... 108/51.3

[58] Field of Search ..... 108/51.3, 51.1; 248/174, 150, 165

[56] References Cited

U.S. PATENT DOCUMENTS

| | | | |
|---|---|---|---|
| 2,444,183 | 6/1948 | Cahners | 248/120 |
| 2,728,545 | 12/1955 | Hermitage | 248/120 |
| 3,464,371 | 9/1969 | Gifford | 108/57 |
| 3,659,534 | 5/1972 | Childs | 108/56 |
| 3,683,822 | 8/1972 | Roberts et al. | 108/56 |
| 4,102,525 | 7/1978 | Albano | 248/174 |
| 4,563,377 | 1/1986 | Melli | 428/36 |
| 4,792,325 | 12/1988 | Schmidtke | 493/334 |
| 4,867,074 | 9/1989 | Quasnick | 108/51.3 |
| 5,001,991 | 3/1991 | Smith | 108/51.3 |

FOREIGN PATENT DOCUMENTS

| | | |
|---|---|---|
| 84906 | 5/1986 | European Pat. Off. . |
| 2152068 | 3/1973 | France . |
| 512367 | 10/1971 | Switzerland . |
| 620701 | 3/1949 | United Kingdom . |

*Primary Examiner*—Kenneth J. Dorner
*Assistant Examiner*—Gerald A. Anderson

[57] ABSTRACT

A pallet stringer, generally trapezoidal when viewed endwise, is folded from a corrugated cardboard sheet so as to have six panels on each side of a vertical plane and a lower panel intersected by the plane, namely an outer panel extending upwardly from the lower panel, an outer panel extending inwardly from the upwardly extending outer panel, toward and approximately to the generally vertical plane, an inner panel extending downwardly from the inwardly extending outer panel, toward and approximately to the lower panel, an inner panel extending outwardly from the downwardly extending inner panel, overlying the lower panel, and extending toward and approximately to the upwardly extending outer panel, an inner panel extending upwardly and inwardly from the inner panel overlying the lower panel, and extending toward and approximately to the downwardly extending inner panel, and an inner panel extending outwardly from the upwardly and inwardly extending inner panel, underlying the inwardly extending outer panel, and extending toward and approximately to the upwardly extending outer panel. The improved stringer may be advantageously combined with a decking member extending through aligned apertures in certain panels. Certain panels are secured adhesively to other panels.

10 Claims, 1 Drawing Sheet

Fig. 1
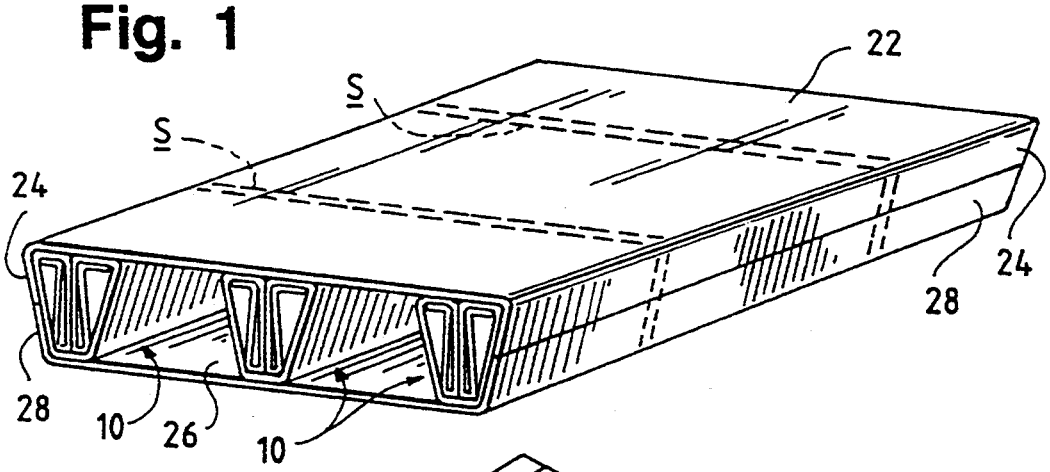
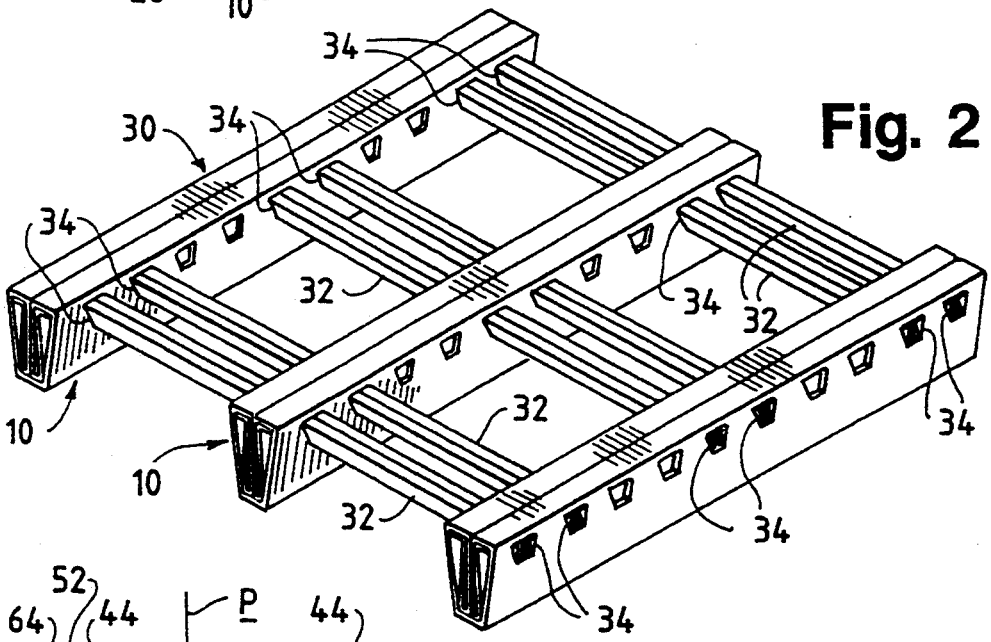
Fig. 2
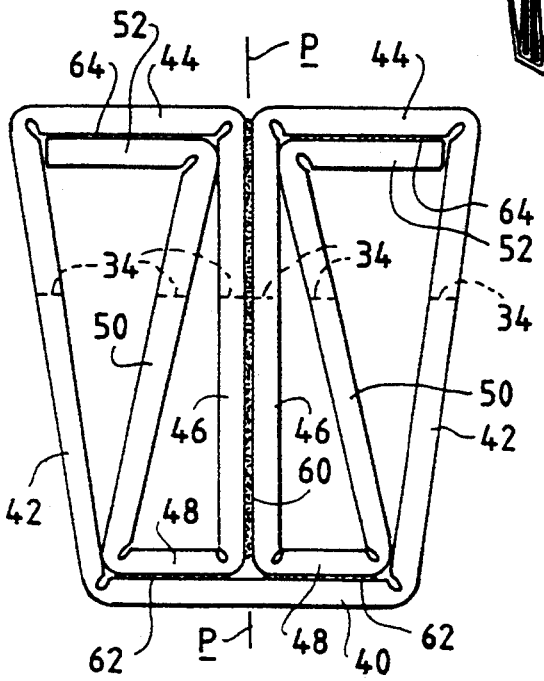
Fig. 3

PALLET STRINGER

CROSS-REFERENCE TO RELATED APPLICATION

This application is a continuation-in-part of U.S. patent application Ser. No. 08/038,001 filed Mar. 29, 1993, now U.S. Pat. No. 5,365,857 and assigned commonly herewith.

TECHNICAL FIELD OF THE INVENTION

This invention pertains to an improved stringer for a pallet of a type made predominantly of paperboard material, such as corrugated paperboard or multi-ply paper. The improved stringer exhibits high compressive strength and good lateral stability.

BACKGROUND OF THE INVENTION

As made predominantly of corrugated paperboard, multi-ply paper, or similar material, pallets of the type noted above and methods for their manufacture are exemplified in Schmidtke U.S. Pat. No. 4,792,325, Quasnick U.S. Pat. No. 4,867,074, and Smith U.S. Pat. No. 5,001,991. Typically, such a pallet comprises elongate stringers and decking members, each having a desired configuration when viewed endwise.

As disclosed in each of these patents, each stringer has a generally trapezoidal configuration when viewed endwise, as a result of a sheet of corrugated paperboard, multi-ply paper, or similar material having been folded to form multiple panels, which define two symmetrical halves of such stringer. Moreover, in each stringer, certain panels are secured adhesively to other panels.

Pallets employing such stringers are available commercially from Gate Pallet Systems, Inc. of Crown Point, Ind., under its PAYLOAD trademark. Efforts to improve such pallets by improving the stringers used in such pallets have led to this invention.

Other pallets of related interest are disclosed in Hermitage U.S. Pat. No. 2,728,545, Roberts et al. U.S. Pat. No. 3,683,822, Melli U.S. Pat. No. 4,563,377, and Atterby et al. U.S. Pat. No. 4,802,421.

SUMMARY OF THE INVENTION

This invention provides an improved stringer for a pallet made predominantly of paperboard material, such as corrugated paperboard or multi-ply paper. The improved pallet is folded from a single sheet of such material so as to have at least thirteen panels. These panels include six panels on each side of a generally vertical plane and a lower panel intersected by the generally vertical plane.

On each side of the generally vertical plane, an outer panel attached at a fold in the sheet to the lower plane extends upwardly from the lower plane. Also, an outer panel attached at a fold in the sheet to the upwardly extending outer panel extends inwardly from the upwardly extending outer panel, toward and approximately to the generally vertical plane. Further, an inner panel attached at a fold in the sheet to the inwardly extending outer panel extends downwardly from the inwardly extending outer panel, toward and approximately to the lower panel. Moreover, an inner panel attached at a fold in the sheet to the downwardly extending inner panel, extends outwardly from the downwardly extending inner panel, overlies the lower panel, and extends toward and approximately to the upwardly extending outer panel. Moreover, an inner panel attached at a fold in the sheet to the inner panel overlying the lower panel extends upwardly and inwardly from the overlying panel and extends toward and approximately to the downwardly extending inner panel. Furthermore, an inner panel attached at a fold in the sheet to the upwardly and inwardly extending inner panel extends outwardly from the upwardly and inwardly extending inner panel, underlies the inwardly extending outer panel, and extends toward and approximately to the upwardly extending outer panel.

Preferably, the inner panel underlying the inwardly extending outer panel is secured adhesively to the inwardly extending outer panel, on each side of the generally vertical plane. Preferably, moreover, the inner panel overlying the lower panel is secured adhesively to the lower panel, on each side of the generally vertical plane. Preferably, moreover, the downwardly extending inner panels are secured adhesively to each other.

A plurality of the improved stringers can be advantageously combined with a plurality of decking members made predominantly of paperboard material, such as the decking members disclosed in the Schmidtke patent noted above, to form a predominantly paperboard pallet.

Desirably, when the improved stringer is combined with a decking member extending through aligned apertures in the upwardly extending outer panels, the upwardly and inwardly extending inner panels, and the downwardly extending inner panels, the decking member is secured adhesively to the inner panel underlying and secured adhesively to the inwardly extending outer panel.

A plurality of the improved stringers can be alternatively combined with an upper sheet of paperboard material or with upper and lower sheets of paperboard material, as disclosed in a commonly owned, copending application, U.S. patent application Ser. No. 07/906,356 filed Jun. 30, 1992, to form a predominantly paperboard pallet.

Whether employing such decking members, such an upper sheet, or such upper and lower sheets, a predominantly paperboard pallet employing the improved stringers exhibits high compressive strength and good lateral stability.

These and other objects, features, and advantages of this invention are evident from the following description of a preferred embodiment of this invention with reference to the accompanying drawings.

BRIEF DESCRIPTION OF THE DRAWINGS

FIG. 1 is a perspective view of a predominantly paperboard pallet employing three stringers according to this invention together with an upper sheet and a lower sheet.

FIG. 2 is a perspective view of a predominantly paperboard pallet employing three stringers according to this invention together with three pairs of decking members.

FIG. 3 is an end view of an improved stringer according to this invention, as used in the pallet of FIG. 2.

DETAILED DESCRIPTION OF PREFERRED EMBODIMENT

As shown in the drawings, an improved stringer 10 constituting a preferred embodiment of this invention is useful in making a predominantly paperboard pallet exhibiting high compressive strength and good lateral stability.

Thus, in one such pallet 20 shown in FIG. 1, three such stringers 10 are combined with an upper sheet 22 having two outer flaps 24 folded downwardly and with a lower sheet 26 having two outer flaps 28 folded upwardly. The upper and lower sheets 22, 26, and the outer flaps 24, 28, are secured adhesively to the stringers 10. Optional reinforcing straps S are shown in dashed lines. Except for the stringers 10, the pallet 20 is similar to a pallet illustrated and described in the copending U.S. patent application Ser. No. 07/906,356 noted above, the disclosure of which is incorporated herein by reference.

Also, in another such pallet 30 shown in FIG. 2, three such stringers 10 are combined with three pairs of decking members 32 extending through apertures 34 in the stringers 10. The decking members 32 are secured adhesively to the stringers 10 at margins of the apertures 34. Each decking member 32 is folded from a single sheet of paperboard material, such as the material used for the stringers 10, so as to have multiple panels, some of which panels are secured adhesively to other panels of such decking member 32. Each decking member 32 is similar to the decking members disclosed in the Schmidtke patent noted above. Except for the stringers 10, the pallet 30 is similar to the pallets disclosed in the Quasnick and Schmidtke patents noted above, the disclosures of which patents are incorporated herein by reference.

The improved stringer 10 is folded from a single sheet of double wall, corrugated paperboard, which may be tape-reinforced or fiber-reinforced. Single wall, corrugated paperboard or multi-ply paper may be alternatively used.

Herein, directional terms including "upper", "lower", "vertical", "horizontal", "upwardly", "downwardly", "inwardly", and "outwardly" refer to the improved stringer 10 and the pallets 20, 30, in preferred orientations, in which they are shown. The improved stringer 10 and the pallets 20, 30, would be also useful in inverted orientations. Usage of such directional terms is not intended to restrict this invention to the preferred orientation.

As shown in FIG. 3, the improved stringer 10 is folded so as to have thirteen panels, namely six panels on each side of an imaginary, generally vertical plane P and a generally horizontal, lower panel 40, which is intersected by the plane P. Also, as shown in FIG. 3, the lower panel 40 is bisected by the plane P. Preferably, as shown, the improved stringer 10 is folded along parallel folding lines extending in a transverse direction relative to flutes of the single sheet of corrugated paperboard.

On each side of the plane P, an outer panel 42 extends upwardly and outwardly from the lower panel 40, extending at an obtuse angle relative to the lower panel 40. Also, an outer panel 44 is attached at a fold in the sheet to the upwardly and outwardly extending panel 42 and extends inwardly from the same panel 42, extending toward and approximately to the plane P. Further, an inner panel 46 is attached at a fold in the sheet to the inwardly extending outer panel 44 and extends downwardly from the same panel 44, extending toward and approximately to the lower panel 40. Moreover, an inner panel 48 is attached at a fold in the sheet to the downwardly extending inner panel 46 and extends outwardly from the same panel 46, overlying the lower panel 40 and extending toward and approximately to the upwardly and outwardly extending outer panel 42. Moreover, an inner panel 50 is attached at a fold in the sheet to the outwardly extending inner panel 48 and extends upwardly and inwardly from the same panel 48, extending toward and approximately to the downwardly extending inner panel 46 and the inwardly extending outer panel 44. Furthermore, an inner panel 52 is attached at a fold in the sheet to the upwardly and inwardly extending inner panel 50 and extends outwardly from such panel 50, underlying the inwardly extending outer panel 44 and extending to and approximately toward the upwardly and outwardly extending outer panel 42.

As shown in FIG. 3, the downwardly extending inner panels 46 are secured adhesively to each other, in a wide region 60 between those panels 46. Moreover, on each side of the plane P, the outwardly extending inner panel 48 overlying the lower panel 40 is secured adhesively to the lower panel 40, in a wide region 62. Preferably, as shown, the regions 62 on both sides of the plane P are contiguous. Furthermore, on each side of the plane P, the outwardly extending inner panel 52 underlying the inwardly extending outer panel 44 is secured adhesively to the same panel 44, in a wide region 64. The adhesive regions 60, 62, 64, extend along substantially the entire length of the improved stringer 10.

Preferably, the adhesive applied in the regions 52, 54, 56, is a so-called "cold melt" or "cold set" adhesive, such as Code No. 3715 or Code No. 3715B, both of which are available commercially from H. B. Fuller Co. of Palatine, Ill.

In the pallet 30, which is shown in FIG. 2, the apertures 34 are located so as to permit the decking members 32 to pass closely beneath the outwardly extending inner panels 52 of the respective stringers 10. Preferably, the upper surfaces of the decking members 32 are secured adhesively to those panels 52 of the respective stringers 10, by one of the adhesives noted in the preceding paragraph.

As shown in FIG. 3, because each of the outer panels 42 extend upwardly and outwardly at an obtuse angle relative to the lower panel 40, the improved stringer 10 is generally trapezoidal with opposing triangles on each side of the plane P, when viewed endwise. Moreover, the improved stringer 10 is generally symmetrical on opposite sides of the plane P, when viewed endwise.

As illustrated and described, the improved stringer 10 compares favorably in compressive strength, offers improved lateral stability but requires less material as compared to a stringer having similar overall dimensions and folded and secured adhesively as disclosed in the Quasnick patent noted above, and as compared to a stringer having similar overall dimensions and folded and secured adhesively as disclosed in the parent U.S. patent application Ser. No. 08/038,001 noted above.

The improved stringer 10 can be additionally stabilized with reinforcing pieces, such as the reinforcing pieces disclosed in Smith U.S. Pat. No. 5,001,991. Such reinforcing pieces are not needed in many cases, however, because of the improved lateral stability offered by the improved stringer 10. If such reinforcing pieces are not used, a predominantly paperboard pallet made with stringers like the improved stringer 10 is less expensive to make and can be more readily recycled.

Various modifications may be made in the preferred embodiment described above without departing from the scope and spirit of this invention.

We claim:

1. A pallet stringer folded from a single sheet of paperboard material so as to have at least thirteen panels, which include six panels on each side of a generally vertical plane and a lower panel intersected by the generally vertical plane, wherein the panels on each side include (a) an outer panel attached at a fold in the sheet to and extending upwardly from the lower panel, (b) an outer panel attached at a fold in the sheet to and extending inwardly from the upwardly extending outer panel, and extending toward and approximately to the generally vertical plane, (c) an inner panel attached at a fold in the sheet to and extending downwardly from the inwardly extending outer panel, and extending toward and approximately to the lower panel, (d) an inner panel attached at a fold in the sheet to and extending outwardly from the downwardly extending inner panel, overlying the lower panel, and extending toward and approximately to the upwardly extending outer panel, (e) an inner panel attached at a fold in the sheet to and extending upwardly and inwardly from the inner panel overlying the lower panel, and extending toward and approximately to the downwardly extending inner panel and the inwardly extending outer panel, and (f) an inner panel attached at a fold in the sheet to and extending outwardly from the upwardly and inwardly extending inner panel, underlying the inwardly extending outer panel, and extending toward and approximately to the upwardly extending outer panel, wherein the inner panel underlying the inwardly extending outer panel is secured adhesively to the inwardly extending outer panel, on each side of the generally vertical plane, and wherein the inner panel overlying the lower panel is secured adhesively to the lower panel, on each side of the generally vertical plane.

2. The pallet stringer of claim 1 wherein the downwardly extending inner panels are secured adhesively to each other.

3. The pallet stringer of claim 2 wherein the upwardly and inwardly extending inner panel is secured adhesively to the downwardly extending inner panel, near the inwardly extending inner panel, on each side of the generally vertical plane.

4. The pallet stringer of claim 2 wherein the upwardly and inwardly extending inner panel is secured adhesively to the upwardly extending outer panel, near the lower panel, on each side of the generally vertical plane.

5. The pallet stringer of claim 4 wherein the upwardly and inwardly extending inner panel is secured adhesively to the downwardly extending inner panel, near the inwardly extending inner panel, on each side of the generally vertical plane.

6. The pallet stringer of claim 1 combined with a decking member extending through aligned apertures in the upwardly extending outer panels, the upwardly and inwardly extending inner panels and the downwardly extending inner panels, the decking member being secured adhesively to the inner panel underlying the inwardly extending outer panel.

7. The pallet stringer of claim 2 combined with a decking member extending through aligned apertures in the upwardly extending outer panels, the upwardly and inwardly extending inner panels, and the downwardly extending inner panels, the decking member being secured adhesively to the inner panel underlying and secured adhesively to the inwardly extending outer panel.

8. The pallet stringer of claim 1 combined with a decking member extending through aligned apertures in the pallet stringer, the decking member being secured adhesively to one of the inner panels attached at folds in the sheet to the upwardly and inwardly extending inner panel on each side of the generally vertical plane.

9. The pallet stringer of claim 1 wherein the single sheet of paperboard material is folded so as to have precisely thirteen panels, and so as to have two opposite edges, each of which is defined by one of the outwardly extending inner panels.

10. The pallet stringer of claim 9 wherein the inner panel underlying the inwardly extending outer panel is secured adhesively to the inwardly extending outer panel, on each side of the generally vertical plane, wherein the inner panel overlying the lower panel is secured adhesively to the lower panel, on each side of the generally vertical plane, and wherein the downwardly extending inner panels are secured adhesively to each other.

* * * * *